US005472358A

United States Patent [19]

Tan et al.

[11] Patent Number: 5,472,358

[45] Date of Patent: Dec. 5, 1995

[54] CONTACT OF SINGLE PITCH ARRANGEMENT IN STRIP STOCK

[75] Inventors: Haw-Chan Tan, Diamond Bar; Tim S. L. Chang, Chino Hills, both of Calif.

[73] Assignee: Genrife Company Linited, Hong Kong

[21] Appl. No.: 221,442

[22] Filed: Apr. 1, 1994

[51] Int. Cl.[6] ..... H01R 11/22

[52] U.S. Cl. ..... 439/851; 439/751

[58] Field of Search ..... 439/842–844, 439/851, 857, 82, 271, 856, 751

[56] References Cited

U.S. PATENT DOCUMENTS

| | | | |
|---|---|---|---|
| 4,722,704 | 2/1988 | VanDerStuyf et al. | 439/851 |
| 4,776,651 | 10/1988 | Paulo | 439/857 |
| 5,183,421 | 2/1993 | Yin | 439/857 |
| 5,256,088 | 10/1993 | Lu et al. | 439/851 |
| 5,273,461 | 12/1993 | Lee | 439/637 |

*Primary Examiner*—Larry I. Schwartz
*Assistant Examiner*—Jill DeMello

[57] ABSTRACT

A socket contact (1) for use with a connector (40) includes a main body (10) and a tail (12) integrally extending from the rear portion thereof and perpendicular to the main body (10). An engagement section (14) is positioned on the front portion of the main body (10), and a retention section (16) is positioned on the rear portion of the main body (10). The engagement section (16) includes a thinner U-shaped member (20) at the front end, a thicker U-shaped member (22) at the rear end, and two curved beams (23, 24) integrally intermediating therebetween, respectively, oppositely facing to each other. The two U-shaped members (20, 22) horizontally and transversely lie in the corresponding cavity (44) in the connector (40) in the same direction, and therefore the two opposite curved beams (23, 24) can sandwich an inserted male pin contact therebetween in a vertical direction.

7 Claims, 5 Drawing Sheets

CONTACT OF SINGLE PITCH ARRANGEMENT IN STRIP STOCK

BACKGROUND OF THE INVENTION

1. Field of the Invention

The invention relates to contacts for use with connectors, especially to female or socket type contacts which can be arranged in a single pitch manner of the raw strip to save the material and implement one-step installation of such contacts into the corresponding connector.

2. The Prior Art

Memory cards and I/O cards became popular in the recent years in which the standard 68 pins socket connector is required for connection of the inner circuit with the computer. Many types of contacts are used in such socket connectors or the like, for example, U.S. Pat. Nos. 4,564,258, 4,666,227, 4,687,278, 4,707,052, 4,720,277, 4,721,484, 4,722,704, 4,767,350, 4,840,588, 4,874,338, 4,886,747, 4,909,746 and 5,256,088. Most conventional socket type female contacts are generally arranged in a double-pitch manner of the raw strip because the socket type female contact needs more material in a double-pitch layout to form itself for providing the sufficient space therein and the contact area thereof for electrically receiving the inserted corresponding male contact therein. In other words, the pitch of two adjacent contacts of the strip stock is twice as the pitch of two adjacent cavities of the corresponding connector into which such contacts will be inserted. The double-pitch arrangement of the contacts in the raw strip results in two disadvantages. One is that too many scraps are left during stamping the blank(s) between two adjacent contacts or of the contact itself in such a raw strip. The other is that it is required to install the contacts in the connector by two individual insertion procedure steps wherein the first step provides only the odd (even) numbers of contacts in the connector, and the second step provides the rest of the contacts in the same connector. Thus, it is desired to have the single-pitch arrangement of the contact strip which can overcome the aforementioned two disadvantages.

It is noted that U.S. Pat. Nos. 4,776,651 and 5,183,421 disclose some so-called fine pitch arrangement of the array of the contact strip. Even though such designs may overcome the aforementioned two disadvantages of the conventional double-pitch contact arrangement of the raw strip, the precise bending and forming procedure makes the manufacturing difficult. Additionally, the cantilever type arms of such designs are not easily controllably formed in position in such a tiny structure, and any deviation thereof may result in an uneven stress distribution in such cantilever type fine pitch arrangement contact design.

An object of the present invention is to provide the fine (or one) pitch contact arrangement of the raw strip for not only reducing the material cost of manufacturing socket type contacts, but also simplifying the installation or insertion step of the contacts into the corresponding connector. Another object is to provide a preferred mechanical structure, as a stable and even support beam type configuration of a contact which overcomes the manufacturing restraints and functions, such that a long life-time reliable electrical and mechanical engagement can be obtained during interconnection between such socket female connector of the memory card or I/O card, and the complementary male connector positioned in the computer set.

SUMMARY OF THE INVENTION

According to an aspect of the invention, a socket contact for use with a connector includes a main body and a tail integrally extending from the rear portion of and perpendicular to the main body. An engagement section is positioned on the front portion of the main body, and a retention section is positioned on the rear portion of the main body. The engagement section includes a thinner U-shaped member at the front end, a thicker U-shaped member at the rear end, and two curved beams integrally intermediating therebetween, respectively, oppositely facing to each other. The two U-shaped members horizontally and transversely lie in the corresponding cavity in the connector in the same direction, and therefore the two opposite curved beams can sandwich an inserted male pin contact therebetween in a vertical direction.

DETAILED DESCRIPTION OF THE INVENTION

References will now be made in detail to the preferred embodiments of the invention. While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
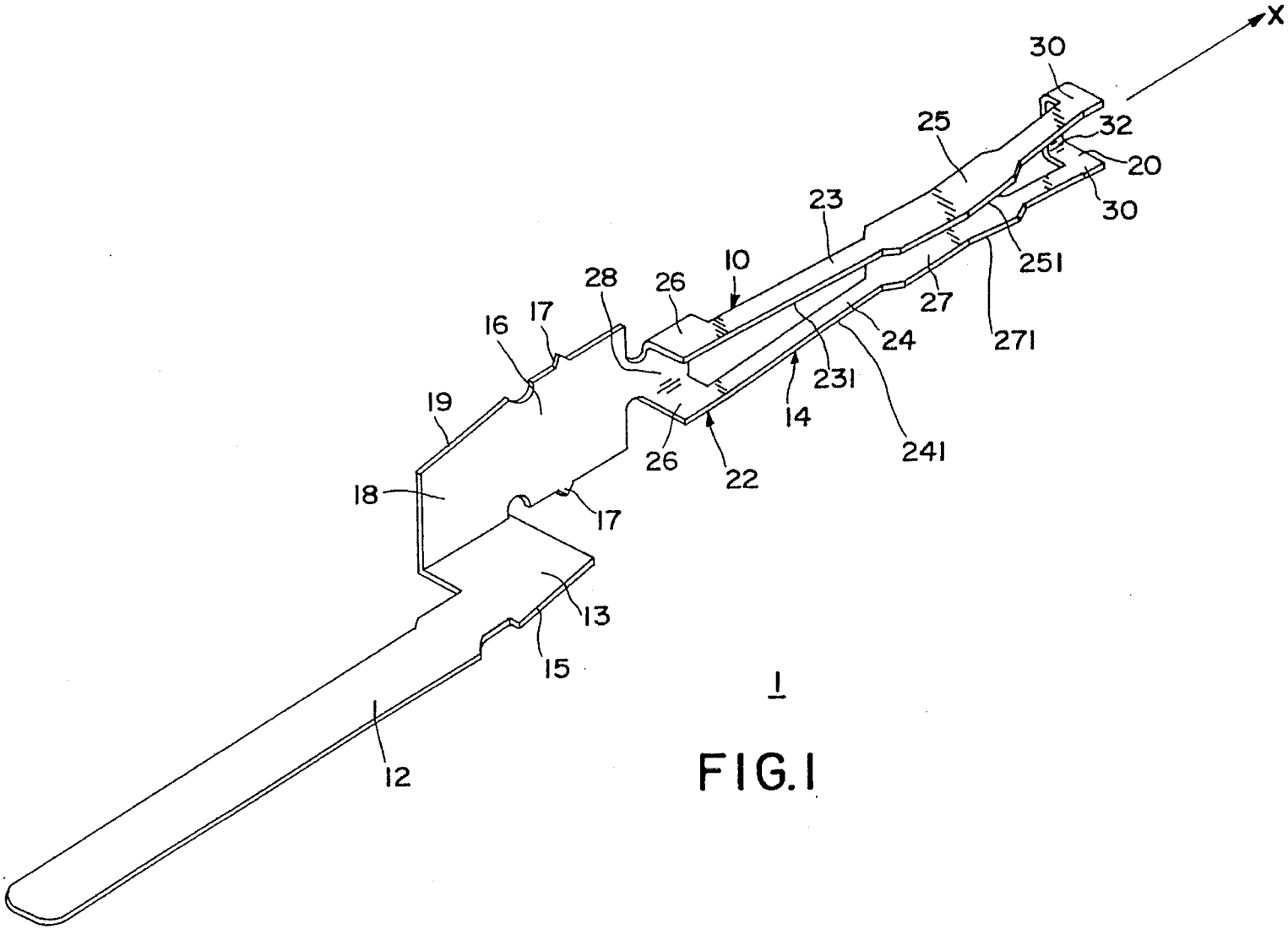
FIG. 1 is an perspective view of a presently preferred embodiment of a contact for use with a socket connector according to the present invention.

It will be noted here that for a better understanding, like components are designated by like reference numerals throughout the various figures in the embodiment. Attention is now directed to FIG. 1 wherein a contact 1 used in a 68 pins socket connector, comprises a main body 10 and an elongated tail 12 integrally extending therefrom and perpendicular thereto.

The main body 10 includes an engagement section 14 on the front portion, a retention section 16 on the rear portion and an intermediating section 18 at the rear end thereof which is integrally connected to and perpendicular to the tail 12.

The engagement section 14 includes a thinner U-shaped member 20 at the front end, a thicker U-shaped member 22 at the rear end, and a pair of opposite curved beams 23, 24 extending intermediating therebetween. The thicker U-shaped member 22 comprises two side arms 26 and a bight 28 intermediating therebetween wherein such bight 28 integrally extends generally in coplanarity with the retention section 16. Thus, the thicker U-shaped member 22 generally lying on its one side arm 26 faces toward a transverse direction with regard to a longitudinal axis X of the contact 1. Similar to the thicker U-shaped member 22, the thinner U-shaped member 20 includes two side arms 30 and a bight 32 intermediating therebetween wherein the bight 32 is coplanar with but spaced in a substantial distance from the bight 28 of the thicker U-shaped member 22. The thinner U-shaped member 20 also lies toward the same direction as that of the thicker U-shaped member 22.

Accordingly, the two opposite beams 23, 24, which are suspensively connected between such two U-shaped members 20, 22, face to each other in a vertical direction with regard to the axis X wherein the outermost edge 231, 241 of the beam 23, 24 are positioned generally flush with the outermost edge (i.e., a top edge in an upright status) of such U-shaped members 20, 22. Such pair of beams 23, 24 gradually converge to the axis X and bow to each other and have the minimum space therebetween at a position spaced from the thinner member 20 in a distance of generally one third of the length of the beam 23, 24. Around such a closest position, each beam 23, 24 has an expansion region 25, 27 for efficiently and sufficiently sandwiching an inserted a male pine contact of a complementary connector (not shown) therebetween so that the contact 1 can provide a good mechanical and electrical engagement with the inserted male contact.

The vertical retention section 16 of the main body 10 has a pair of barbs 17 respectively positioned at the upper edge and the lower edge for retainably engaging the socket connector which will be illustrated in detail later.

The tail 12 includes a stabilizing section 13 at the front end which is integrally connected to the lower edge of the intermediating section 18 of the main body 10 at a right angle so that the main body 10 is generally perpendicular to the tail 12.

Figure 2:
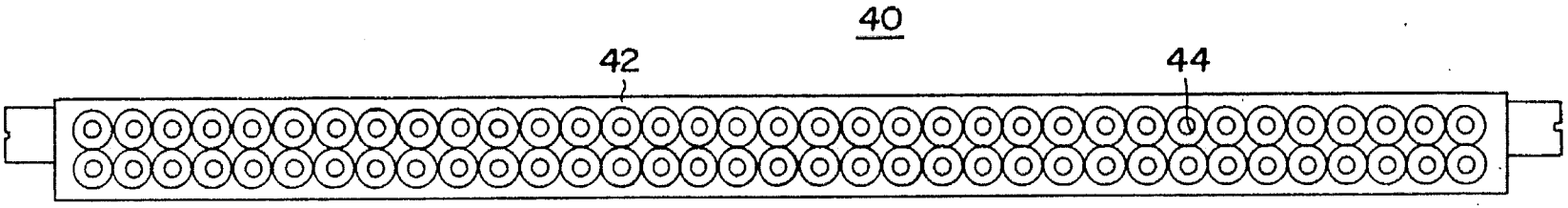
FIG. 2 is front view of the socket connector adapted to receive the contact of FIG. 1 therein.
Figure 3A:
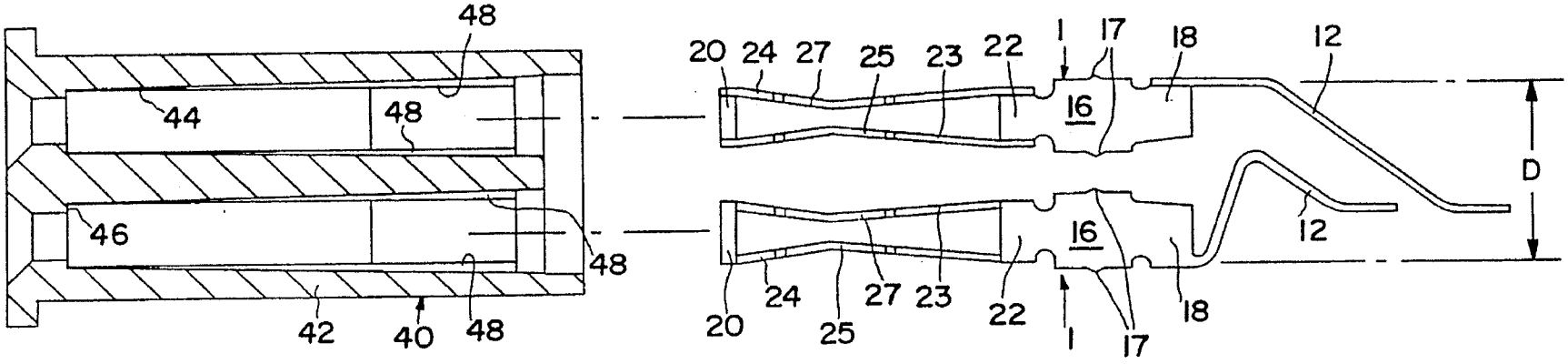
FIG. 3(A) is a vertical cross-sectional view of the connector of FIG. 2 to show the upper row contact and the lower row contact are aside ready to be inserted therein.
Figure 3B:
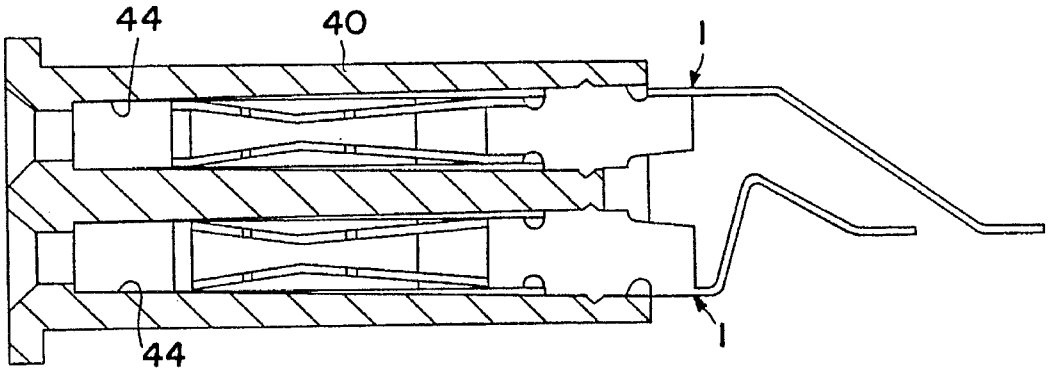
FIG. 3(B) is a vertical cross-sectional view of the connector of FIG. 3(A) during the procedure of insertion of the contacts therein.
Figure 3C:
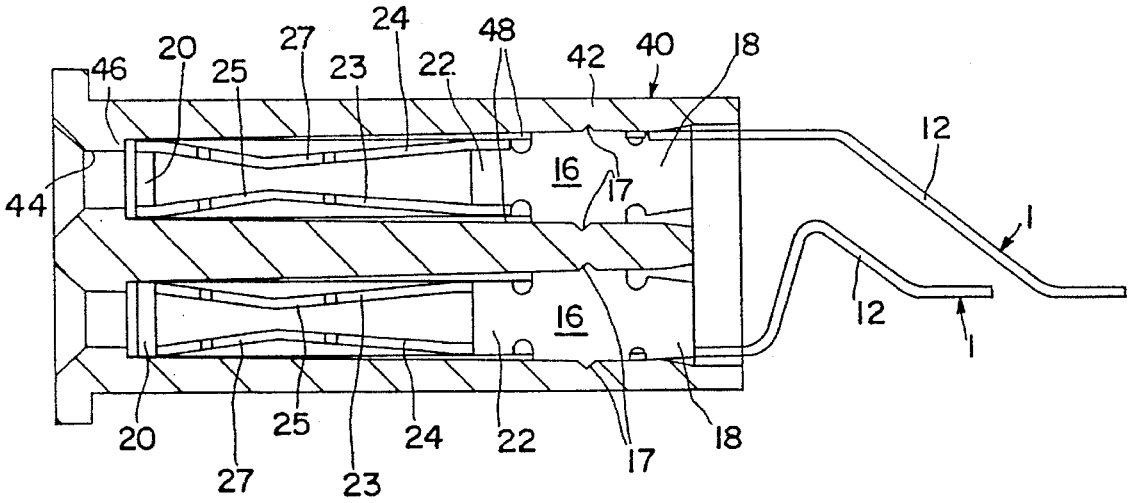
FIG. 3(C) is a vertical cross-sectional view of the connector of FIG. 3(A) having the contacts thoroughly inserted therein.
Figure 3D:
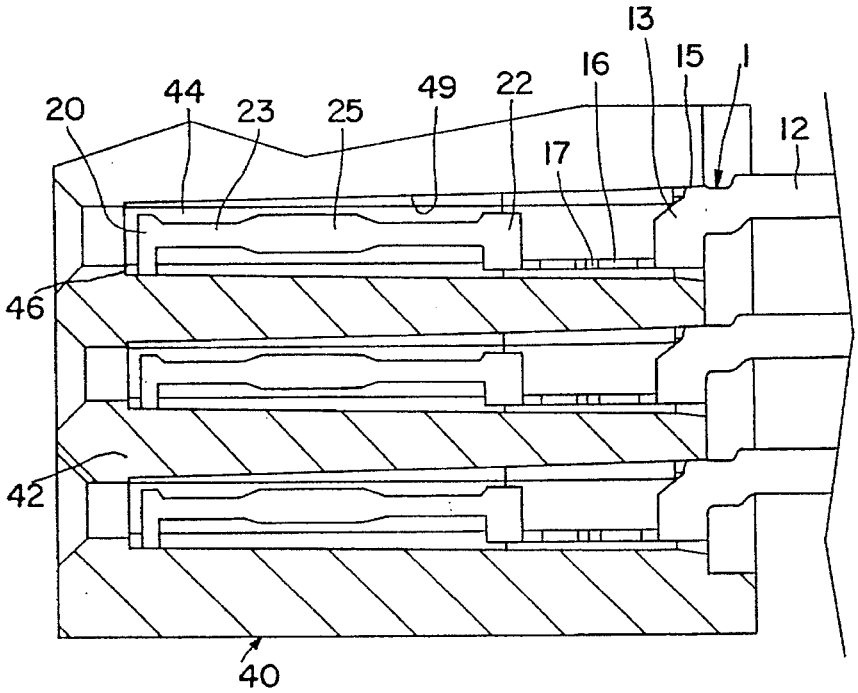
FIG. 3(D) is a fragmentary horizontal cross-sectional view of the connector of FIG. 2 to show the relationship of the contact within the cavity in the connector.

Also referring to FIG. 2, the socket connector 40 includes an insulative elongated housing 42 having two rows of cavities 44 extending therethrough in a front-to-back direction. Each cavity 44 has a reduced dimension adjacent its front end to form a shoulder 46 for restraint of the forward movement of the contact 1. As shown in FIGS. 3(A)–3(C), the upper row contacts 1 can be simultaneously inserted, from the rear, into the corresponding cavities 44, respectively, until the U-shaped member 20 of the main body 10 of each contact 1 almost confronts the shoulder 46 of the corresponding cavity 40. The lower row contacts 1 can be done, similarly. It can be understood that in this embodiment the upper row contact 1 and the lower row contact 1 are respectively loaded into the corresponding cavity 44 in opposite directions. In other words, from a front view of the assembled connector 40, the U-shaped members 20, 22 of the upper row contact 1 face toward the right side, and the U-shaped members 20, 22 of the lower row contact 1 face toward the left side, whereby the stabilizing section 13 of the tail 12 of the contact 1 in the upper row may thereof positioned at the top, and the stabilizing section 13 of the tail 12 of the contact 1 in the lower row may thereof positioned at the bottom. Therefore, the vertical distance D between such two stabilizing sections 13 of each pair of complementary upper and lower row contacts 1 allows the rear portions of the tails 12 of such pair of contacts 1 to extend angularly to enhance resilience thereof and terminate at a same appropriate vertical position for surface mounting on a PC board.

With reference to FIGS. 3(A)–3(D), when the contact 1 is received within the cavity 44, the retention section 16 of the contact 1 can be retained in position by means of the upper and lower barbs 17 being engaged within the upper and the lower slots 48 which is recessed in the housing 42 and communicatively adjacent to the cavity 44. The front U-shaped member 20 touches three sidewalls of the corresponding cavity 44 and is spaced apart from the fourth sidewall 49 which faces to the opening of the U-shaped member 20. Thus, main body 10 of the contact 1 can function as an actuated beam which has one fixed end (at the retention section 16) and one simple support end (at the front U-shaped member 20) and is mechanically superior to the simple cantilever beam. The outermost edge 15 of the stabilizing section 13 of the contact 1 abuts against the tapered portion of the corresponding sidewall 49 beside the cavity 44 so that the tail 12 of the contact 1 can project rearward from the socket connector 40 precisely and the main body 10 of the contact 1 can be retained in the cavity 44 stably.

It is also seen that the cavity 44 in the housing 42 has a tapered configuration in the front-to-end direction so that the contact 1 can be inserted into the cavity 44 easily and without improper interference.

Figure 5:
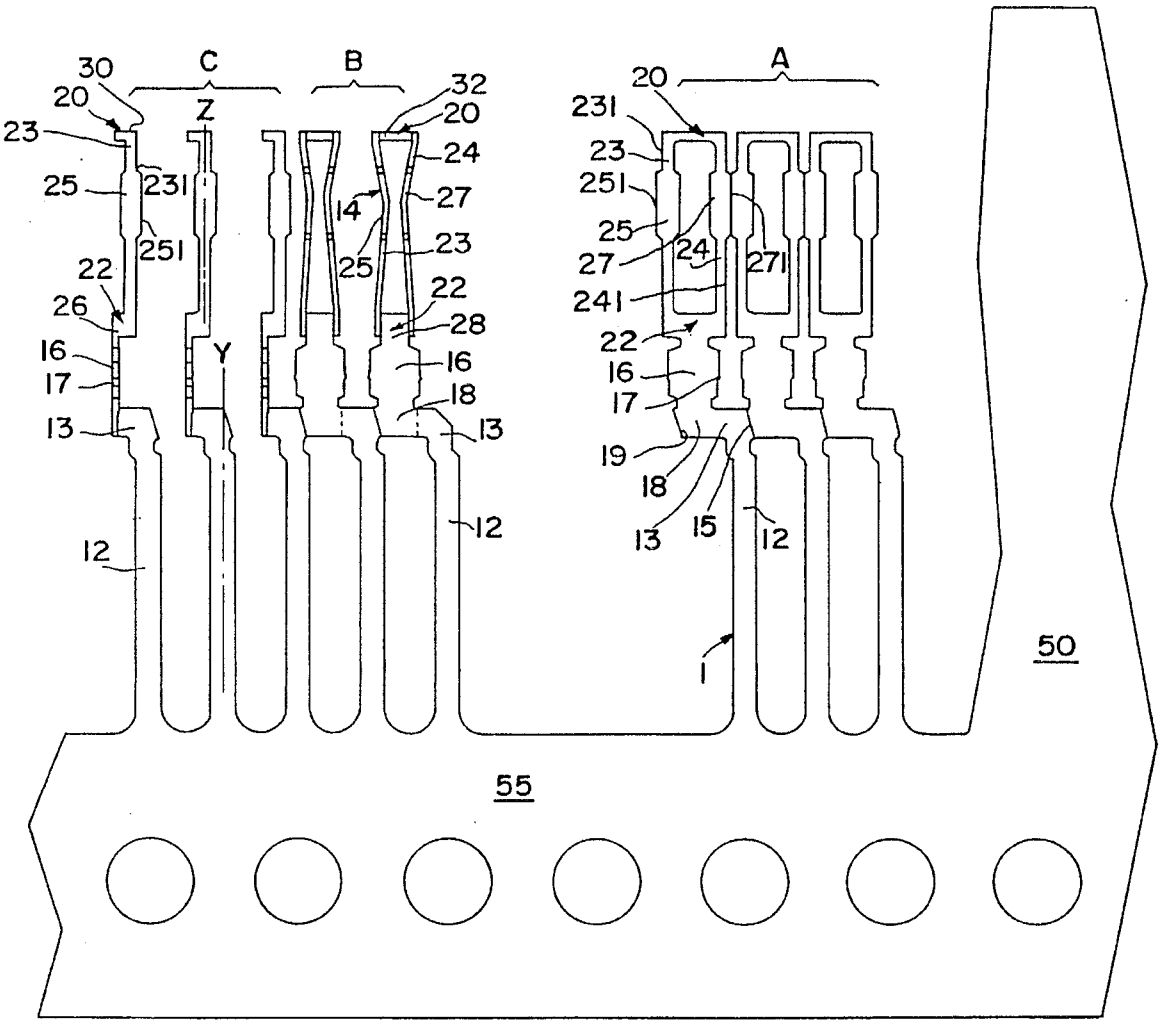
FIG. 5 is a contact strip stock to show a plan view of the progression of the contact during manufacturing including successive stamping, forming, shearing and bending.

With reference to FIG. 5, the contact 1 which is adapted to be arranged in a fine or single pitch array in the raw strip for stamping, is an important feature in the present invention. FIG. 5 shows a plan view of the progression of the contact during manufacturing including successive stamping, forming, shearing and bending.

Portion A in FIG. 5 shows the contact 1 of the strip stock 50 after stamping and shearing but prior to forming and bending. Such stamping includes blanking the metal material in the individual contact itself or between two adjacent contacts. The outermost or first edge 231 of the beam 23 of the contact 1 is spaced apart from the outermost or second edge 241 of the beam 24 of the adjacent contact 1, but the outermost or third edge 251 of the expansion region 25 of the beam 23 of the contact 1 shares a shear line with the outermost or fourth edge 271 of the expansion region 27 of the beam 24 of the same adjacent contact 1. Similarly, the outermost or second edge 241 of the beam 24 of the contact 1 is spaced apart from the outermost or first edge 231 of the beam 23 of the adjacent contact 1, but the outermost or fourth edge 271 of the expansion region 27 of the beam 24 of the contact 1 shares a shear line with the outermost or third edge 251 of the expansion region 25 of the beam 23 of the adjacent contact 1. Additionally, the outermost edge 15 of the stabilizing section 13 of the tail 12 of the contact 1 shares a shear line with the outermost edge 19 of the intermediating section 18 of the adjacent contact 1; similarly, the outermost edge 19 of the intermediating section 18 of the contact 1 also shares a shear line with the outermost edge 15 of the stabilizing section 13 of the tail 12 of the adjacent contact 1. It is noted that such shear line shared by both outermost edges 15, 19 of these two adjacent contacts is generally sloped with regard to the lengthwise direction of such contact strip 50. The tapered edge configuration of the stabilizing section 13 of the contact 1 eases the retainable insertion of the stabilizing section 13 into the cavity 44.

Portion B in FIG. 5 shows that the engagement section 14 of the contact 1 is formed by forming a U-shaped member 20 at the front end, a U-shaped member 22 at the rear end, and a pair of converging beams 23, 24 intermediate such two U-shaped members 20, 22.

Portion C in FIG. 5 shows that the main body 10 including the engagement section 14, the retention section 16 and the intermediating section 18, is bent, along an interconnection edge shared by the imaginary innermost edges of the stabilizing section 14 and of the intermediating section 18, at a right angle to the tail 12 of the contact 1. Finally, the contact 1 shown in the portion C of FIG. 5 can be bent on the tail 12 to form the specific shape thereof for complying the requirements in the connector specification as shown in FIGS. 3(A)–3(C), and the whole array of the processed contacts 1 of such contact strip 50 can be respectively inserted into the corresponding cavities 44 of one of the upper row and the lower row in the connector 40 at only one step, and such contacts 1 are retained within the corresponding cavities 44 and separated from the contact strip stock 50 by cutting the rear ends of the tails 12 therefrom.

It is appreciated that in comparison with the most conventional double-pitch arrangement contact strip, the contact 1 used in the present invention can reduce the scraps of the strip stock 50 during stamping, thus saving the material and cost. Additionally, the single-pitch arrangement of the contact array allows for only one step insertion to complete the whole row contacts installation, thus saving the assembling time.

It is also contemplated that the retention section 16 of the contact i engages the housing 42 in a vertical direction which is perpendicular to the lengthwise direction along the connector housing 42, and therefore, the vertical retention sections 16 of a row of contacts can properly mechanically resist the insertion force along the lengthwise direction of such row.

Figure 4:
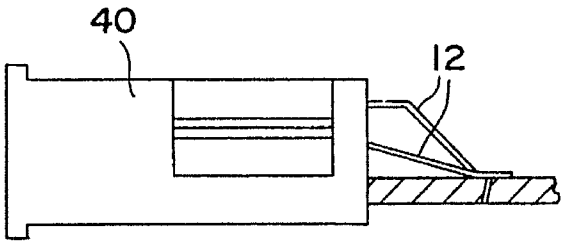
FIG. 4 is a side view of the connector of FIG. 2 having single line contact tails mounted on a PC board.

It is also seen that the centerline of the tail 12 of the contact 1 is transversely offset from the centerline of the engagement section 14 of the contact 1, and such offset is adapted to allow for lateral deviation of the tail end position by changing the stamping die so that the upper row contact tail ends 12 and the lower row contact tail ends 12 can be arranged not only in a two-row manner as shown in FIGS. 3(A)–3(C), for mounting on the PC board on which the connector 40 is seated, but also in a single line high density manner as shown in FIG. 4 for the same. It will be convenient for the design of the circuit traces on such corresponding PC board.

The spirit of the invention is to provide a specific contact design which allows for fine or single pitch arrangement of an array of the strip stock for saving material and easing assembling wherein the slender, thin and tiny stamped and formed engagement beams of the contact can still have a sufficient contact region thereof and the space therein for efficiently sandwiching an inserted male pin contact, and maintain a good resilience and provide reliable and stable engagement force with the inserted male pin contact. Additionally, the retention section 16 of the contact 1 should be large enough and vertically stand in the connector 40 for resisting the insertion force exerted along the lengthwise direction of the connector. Similarly, the stabilizing section 13 of the contact 1 is required to be as large as possible for increasing the butting area for consideration of stabilization of the contact 1 in the cavity 44. Moreover, as shown in Portion C of FIG. 5, the centerline Y of the tail 1 of the contact 1 can be designedly offset, in the transverse direction, with regard to the centerline Z of the engagement section 14 in a range for easy configuration of the corresponding traces on the PC board on which the connector 40 is seated.

Another feature of the invention is shown in FIG. 5, in which portion A shows the arrayed contacts of the strip stock 50 after stamping and shearing but prior to forming and bending wherein the tail 12 of the contact 1 is offset so much that such tail 12 is generally aligned with the beam 23 of the engagement section 14 of the adjacent contact 1 in a direction perpendicular to the base strip 55 of the strip stock 50. Most conventional contacts are arranged and arrayed in the strip in a form in which every contact occupies a generally rectangular basic region for stamping in a later time and such basic region does not protrude transversely. This offset configuration in an extended layout between the engagement section 14 and the tail 12 of the forming and/or bending contact 1 is a feature to implement the present invention.

While the present invention has been described with reference to a few specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

I claim:

1. A contact (1) for use with a connector (40) comprising:

a main body (10) including an engagement section (14) on a front portion and a retention section (16) on a rear portion thereof;

said engagement section (14) including a pair of generally U-shaped members (20, 22) respectively and oppositely positioned at a front end and a rear end, wherein each of said members (20, 22) is composed of two side arms (30, 26) and a bight (32, 28) intermediate said two side arms (30, 26), and a pair of curved beams (23, 24) intermediating between said two U-shaped members (20, 22); and p1 a tail (12) integrally extending rearward from the rear portion of the main body (10) and perpendicular to the main body (10), said tail (12) further comprising a stabilizing section (13) coplanarly at a front end of said tail (12) to be integrally connected, generally at a right angle, to an intermediating section (18) positioned at a rear end of the main body (10) wherein said retention section (16) is substantially coplanarly positioned between said intermediating section (18) and the bight (28) of the U-shaped member (22) and perpendicular to the tail (12), whereby the retention section (16) retainably holds the engagement section (14) in a vertical direction and said stabilizing section (13) stabilizes the engagement section in a horizontal direction.

2. A socket connector (40) comprising:

an insulative elongated housing (42) including a plurality of cavities (44) aligned in at least one row;

a plurality of contacts (1) received within the corresponding cavities (44), respectively;

each of said contacts (1) including:

a main body (10) including an engagement section (14) on a front portion and a retention section (16) on a rear portion thereof;

said engagement section (14) including a pair of generally U-shaped members (20, 22) respectively and oppositely positioned at a front end and at a rear end, and a pair of curved beams (23, 24) intermediating therebetween; and a tail (12) integrally extending rearward from the rear portion of the main body (10) and perpendicular to the main body (10);

said retention section (16) of each of said contacts (1) is vertically positioned in the corresponding cavity (44) in the housing (40) wherein each of said cavities (44) is generally defined by four sidewalls surrounding said cavity (44) whereby said U-shaped member (20) positioned at the front end abuts against three sidewalls and is spaced apart from a fourth sidewall (49) which faces to an opening of said U-shaped member (20) so that the main body (10) of the contact (1) functions as a mechanical beam which generally has one fixed end at said retention section (16) and one simple support end at said U-shaped member (20).

3. The connector as described in claim 2, wherein said contact (1) further includes a stabilizing section (13) perpendicular to the retention section (16) so that said stabilizing section (13) of the contact (1) incorporates said retention section (16) of the contact (1) for stably retaining said contact (1) within the corresponding cavity (44) in both vertical and horizontal directions.

4. A contact strip stock after stamping and shearing but prior to forming and bending comprising a base strip and a plurality of contacts extending therefrom and aligned in an array thereof, each contact comprising:

a main body including an engagement section in a front portion and a retention section in a rear portion thereof;

said engagement section including two members respectively and oppositely at a front end and a rear end, both of the members adapted to be formed in a U-shaped configuration in a later time;

a pair of opposite and spaced first and second beams extending intermediate said two members; and a tail integrally extending rearward from the rear portion of the main body and integrally connected to the base strip of said strip stock, said main body being adapted to be bent at a right angle with regard to the tail in the later time; wherein said first and second beams have first and second engaging means respectively whereby an outermost edge of the first engaging means of the first beam of the contact shares a shear line with an outermost edge of the second engaging means of the second beam of another adjacent contact.

5. The contact strip stock as described in claim 4, wherein said first and second engaging means of the first and second beams are first and second expansion regions about middle portions, respectively, whereby an outermost edge of the first expansion region of the first beam of a first contact shares a shear line with an outermost edge of the second expansion region of the second beam of an adjacent second contact, but an outermost edge of the first beam of the first contact is spaced apart from an outermost edge of the second beam of the adjacent second contact.

6. The contact strip stock as described in claim 5, wherein each of said contacts further includes a stabilizing section positioned at a front end of the tail which is integrally connected to an intermediating section positioned at a rear end of the main body whereby an outermost edge of the stabilizing section of the first contact shares a shear line with an outermost edge of the intermediating section of the adjacent second contact.

7. The contact strip stock as described in claim 5, wherein a first centerline of said engagement section of a first contact is offset from a second centerline of the tail of said first contact in a longitudinal direction of said base strip of the strip stock, so that the tail of said first contact is generally aligned with one beam of the engagement section of the adjacent second contact in a direction vertical to the base strip of the contact strip stock.

* * * * *